US012239276B2

(12) United States Patent
Rauch et al.

(10) Patent No.: US 12,239,276 B2
(45) Date of Patent: Mar. 4, 2025

(54) DOSING UNIT AND WATER-BEARING HOUSEHOLD APPLIANCE

(71) Applicants: Reckitt Benckiser (Brands) Limited, Slough (GB); BSH Hausgeräte GMBH, Munich (DE)

(72) Inventors: Jürgen Rauch, Munich (DE); Alexander Schiele, Munich (DE); Jakob Schultz, Munich (DE); Alexander Sing, Munich (DE)

(73) Assignees: Reckitt Benckiser (Brands) Limited, Slough (GB); BSH Hausgeräte GMBH, Munich (DE)

( * ) Notice: Subject to any disclaimer, the term of this patent is extended or adjusted under 35 U.S.C. 154(b) by 198 days.

(21) Appl. No.: 17/905,768

(22) PCT Filed: Mar. 22, 2021

(86) PCT No.: PCT/EP2021/057203
§ 371 (c)(1),
(2) Date: Sep. 7, 2022

(87) PCT Pub. No.: WO2021/191118
PCT Pub. Date: Sep. 30, 2021

(65) Prior Publication Data

US 2023/0111550 A1 Apr. 13, 2023

(30) Foreign Application Priority Data

Mar. 25, 2020 (GB) ..... 2004309

(51) Int. Cl.
*A47L 15/44* (2006.01)
*D06F 39/02* (2006.01)

(52) U.S. Cl.
CPC ..... *A47L 15/4463* (2013.01); *A47L 15/4445* (2013.01); *A47L 15/4472* (2013.01); *D06F 39/026* (2013.01); *A47L 2401/023* (2013.01)

(58) Field of Classification Search
None
See application file for complete search history.

(56) References Cited

U.S. PATENT DOCUMENTS 3,178,915 A 4/1965 Wilhelm
2009/0266389 A1 10/2009 Classen et al.
(Continued)

FOREIGN PATENT DOCUMENTS

DE 19540958 A1 5/1997
DE 19636417 A1 3/1998
(Continued)

OTHER PUBLICATIONS

Examination Report dated Mar. 1, 2024, issued in EP21715173.7, filed Mar. 22, 2021.
(Continued)

*Primary Examiner* — Levon J Shahinian
(74) *Attorney, Agent, or Firm* — Dunlap Codding, P.C.

(57) ABSTRACT

A dosing unit for use in an automatic dosing system of a water-bearing household appliance for automatically dosing detergent tablets, the dosing unit comprising a storage cartridge for storing a plurality of the detergent tablets and a dosing device for releasing a respective one of the detergent tablets, wherein the storage cartridge includes a tubular section for storing the plurality of detergent tablets ordered in a line one behind the other.

20 Claims, 5 Drawing Sheets

(56) References Cited

U.S. PATENT DOCUMENTS

| | | | |
|---|---|---|---|
| 2015/0359412 | A1 | 12/2015 | Delgado et al. |
| 2019/0307310 | A1 | 10/2019 | Fletcher et al. |

FOREIGN PATENT DOCUMENTS

| | | | |
|---|---|---|---|
| EP | 1159913 | A1 | 12/2001 |
| FR | 1240171 | A | 9/1960 |
| WO | 2017/166980 | A1 | 10/2017 |

OTHER PUBLICATIONS

Search Report and Opinion for United Kingdom Patent Application No. 2004309.7 mailed Aug. 26, 2020.
International Search Report and Opinion for PCT Application No. PCT/EP2021/057203 mailed Jul. 1, 2021.

DOSING UNIT AND WATER-BEARING HOUSEHOLD APPLIANCE

CROSS-REFERENCE TO RELATED APPLICATIONS

This application is a National Stage Entry of, and claims priority to, PCT Patent Application No. PCT/EP2021/057203 filed on Mar. 22, 2021, which claims priority to United Kingdom Patent Application No. GB2004309.7, filed on Mar. 25, 2020, the disclosures of which are herein incorporated by reference in their entireties.

BACKGROUND

The present invention relates to a dosing unit for use in an automatic dosing system of a water-bearing household appliance and a water-bearing household-appliance with such an automatic dosing system.

Known water-bearing household appliances, for example dishwashers, typically have a dosing system, which consists of a chamber for storing a single dose of detergent. The user of the dishwasher has to fill the chamber with the detergent each time before starting a washing cycle. This is inconvenient for the user. Furthermore, such systems bear the risk that the user does not fill in the correct amount of detergent or forgets to fill in detergent at all. This can lead to bad or undesirable cleaning results. It is desired that an automatic dosing system is available, which automatically doses the correct amount of detergent at the correct timings during a washing cycle.

BRIEF DESCRIPTION OF THE FIGURES

The accompanying Figures, which are incorporated in and constitute a part of this specification, illustrate several aspects described below.

DESCRIPTION OF THE INVENTION

Figure 1:
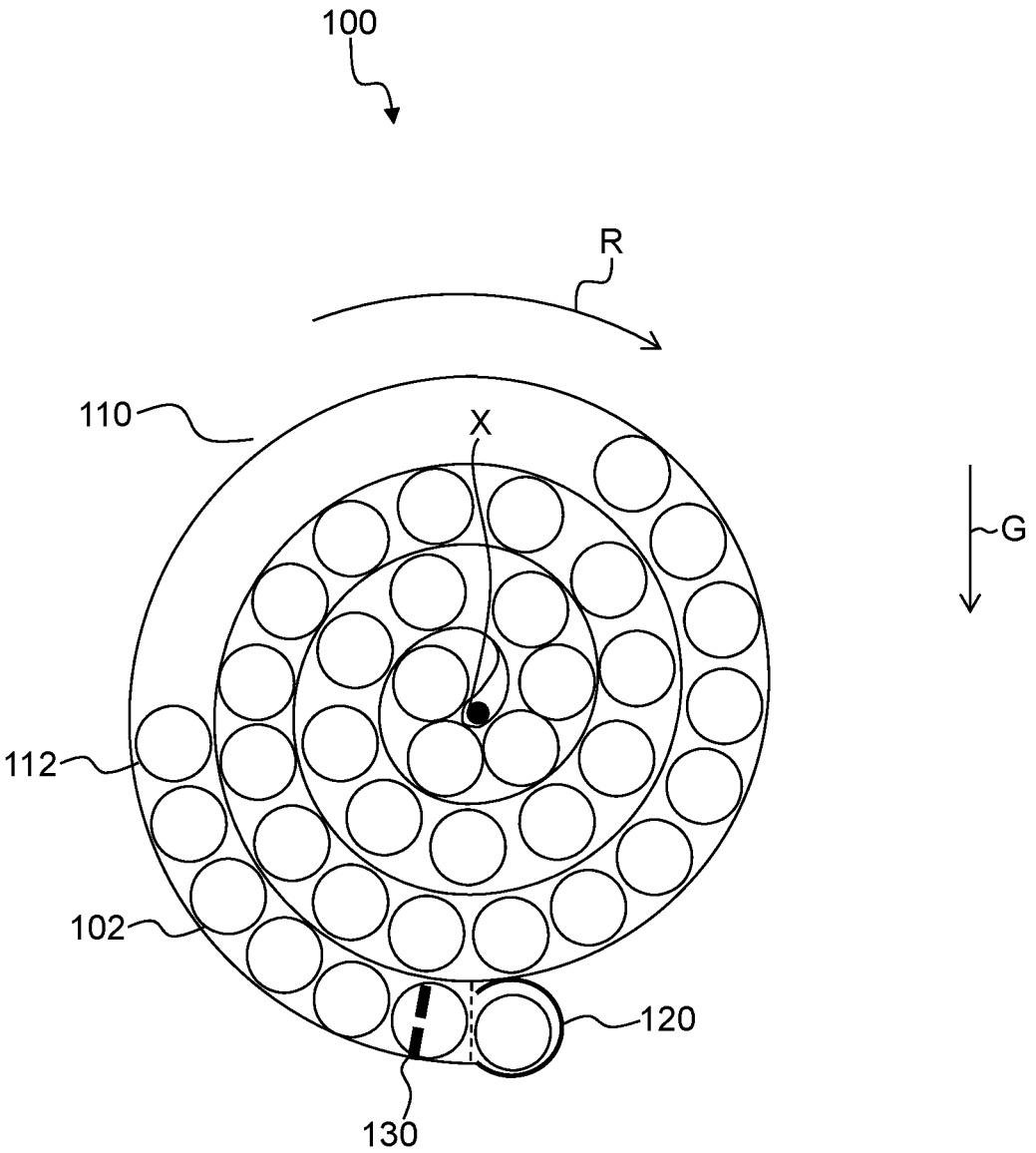
FIG. 1 shows a schematic view of a first example of a dosing unit.

It is one objective of the invention to improve the dosing of detergent in a water-bearing household appliance.

According to a first aspect, a dosing unit for use in an automatic dosing system of a water-bearing household appliance for automatically dosing detergent tablets is suggested. The dosing unit comprises a storage cartridge for storing a plurality of the detergent tablets and a dosing device for releasing a respective one of the detergent tablets. The storage cartridge includes a tubular section for storing the plurality of detergent tablets ordered in a line one behind the other.

The dosing unit may favorably be used in a water-bearing household appliance, in particular a dishwasher or a washing machine, for providing detergent tablets for multiple treatment cycles, without the need to fill in detergent before each cycle. Preferably, the dosing unit can be actuated automatically, for example by a control unit of the water-bearing household appliance. The detergent tablets may be any kind of detergent, that is, a chemical formulation that dissolves, at least partially, in a washing liquor for treating articles and is suitable for enhancing the treatment of the articles by the washing liquor. For example, the detergent includes enzymes, a bleaching agent, a softening agent, a rinse aid, and/or further detergents.

The dosing unit may comprise several elements, such as the dosing device and the storage cartridge, even if not mentioned explicitly. The elements of the dosing unit are preferably made from polymeric materials which are suitable for injection molding. Additionally, the elements may be made from metal and/or a composite material and/or the elements may be coated.

The storage cartridge stores a plurality of detergent tablets in a line one behind the other. Therefore, it is relatively simple to provide single detergent tablets to the dosing device, as compared to a system where detergent tablets are stored in an unordered way. Further, the suggested dosing unit has the advantage that essentially only the detergent tablet that will be released in the next dosing step is close to an outlet, from where humidity may enter into the storage cartridge. Thus, essentially only this detergent tablet will be affected by the humidity. One can say, that the first detergent tablet in the line absorbs the humidity entering the storage cartridge, thus protecting the other detergent tablets of the plurality.

For example, the storage cartridge has a linear tubular section. The dosing device is attached to the storage cartridge at one end of the tubular section. For example, the dosing unit is oriented such that the dosing device is at a lowest position of the dosing unit. Then, gravity acts on the detergent tablets arranged in the tubular section and drives them towards the dosing device.

The dosing device includes, for example, a sliding mechanism for releasing the detergent tablet. Preferably, the dosing device has a closed state, in which the storage cartridge is sealed, and has a release state, in which an outlet is cleared such that detergent tablet that is next to the dosing device in the line is released.

An advantage of the dosing unit is that only the dosing device needs to be operated, because the detergent tablets automatically slide to the dosing device after a detergent tablet was released.

The detergent tablets are preferably provided as formed bodies comprising a specific detergent formulation and having a specific size and geometry. The detergent tablets preferably comprise one or more active ingredients for an automatic washing process. As will be appreciated by the skilled person, the nature of the active ingredient(s) used in the detergent tablets will vary depending on the desired application. When used inside a dishwasher, the detergent tablets may, for example, comprise an active ingredient performing a dishwasher detergent, rinse aid, machine cleaner or dishwasher deodorizing function. In the context of laundry washing machines, the detergent tablets may, for example, comprise an active ingredient performing a laundry detergent or fabric softener function. Suitable active ingredients will be known to the skilled person; examples include bleach, bleach activator, bleach catalyst, enzyme, surfactant, builder, pH-adjusting agent, corrosion inhibitor, and fragrance.

For example, each detergent tablet contains a unit dose of the active ingredient, i.e. the entire amount of the active ingredient desired to be used in the washing process, such that only one detergent tablet of that active ingredient needs to be dispensed per washing process. In other embodiments, it may be an advantage for the unit dose of the active ingredient to be provided by more than one detergent tablet. For example, in some cases a single detergent tablet containing the entire unit dose may be rather large or heavy, and dosing may be more effective or reliable using multiple smaller or lighter detergent tablets. Preferably, the desired dose of the active ingredient is provided by no more than 10 detergent tablets, preferably no more than 9, 8, 7, 6, 5, or 4 detergent tablets. Preferably, the unit dose is provided by 1, 2, 3 or 4 detergent tablets. Another useful option is to provide detergent tablets each of which contains an amount of active ingredient that corresponds to no more than one unit dose of the active ingredient for at least one washing process of the automatic washing machine. For example, the dishwasher or washing machine is configured to allow selection between various different modes of operation, such as an intensive wash program and a light wash program, which require different amounts of the active ingredient. Thus, a number of detergent tablets may be dosed during one mode of operation and a different number of detergent tablets are dosed during a different mode of operation. For example, one detergent tablet may be dosed during a wash program for a certain soiling level and two detergent tablets during a wash program designed for a higher level of soiling. The detergent tablets may be of any suitable form, such as solid, gel tab, or water-soluble package/container (preferably of low deformability). Preferably, at least the exterior of the detergent tablets are solid. For example, a capsule of a dissolvable (preferably hard) shell material could enclose a powder, liquid or gel composition. Advantageously, however, the detergent tablets are formed of a compressed powder. Each detergent tablet may, for example, be single phase or multi-layered, and may be otherwise structured to ensure that each active ingredient is released from the detergent tablet at the most optimal time. The detergent tablets may be wrapped in a film of water-soluble material, but preferably they are unwrapped. They may be coated with a suitable coating, e.g. to reduce friability. The detergent tablets may be of any suitable shape, such as cylindrical, disc-shaped, spherical, spheroidal, or cuboid. In an embodiment, each detergent tablet has at least one flat face. Preferably, the detergent tablets are cylindrical or disc-shaped, since spherical detergent tablets are more difficult to manufacture whilst shapes such as cuboid are less easily dispensed. In the case of a cylindrical detergent tablet, preferably the length of the tablet is up to 5% more or less than the diameter of the detergent tablet. When the detergent tablet has edges, preferably at least some of these edges are chamfered and/or filleted to reduce the liability to chip during manufacture and whilst the detergent tablet is in the dosing device. Preferably the chamfer has an angle of 15 to 20 degrees.

In an embodiment, each detergent tablet has a weight of: at least 0.1 g, at least 0.5 g, at least 0.7 g, at least 1 g, at least 1.2 g, at least 1.5 g, at least 2 g, at least 3 g, at least 4 g, or at least 5 g; and/or up to 15 g, up to 14 g, up to 13 g, up to 12 g, up to 1.1 g, up to 10 g, up to 9 g, up to 8 g, up to 7 g, or up to 6 g. In an embodiment, each detergent tablet has a maximum length and/or diameter of: at least 5 mm, at least 6 mm, at least 7 mm, at least 8 mm, at least 9 mm, or at least 10 mm; and/or up to 20 mm, up to 19 mm, up to 18 mm, up to 17 mm, up to 16 mm, or up to 15 mm.

The dosing unit has the advantage that it can be manufactured at low cost, such that when the storage cartridge runs empty of detergent tablets, the whole dosing unit can simply be replaced. A refilling of the storage cartridge may be possible, but is not necessary. It can be very convenient for a user of the water-bearing household appliance with the automatic dosing system to simply replace the whole dosing unit, which may be provided with different kinds of detergent tablets for different applications or different treatment programs.

Instead of replacing the dosing unit, it can be preferred to refill the storage cartridge with detergent tablets. For this, a refilling package may be provided, which provides detergent tablets arranged in a line one behind the other, to be attached to the storage cartridge from one end of the tubular section. The storage cartridge may have a filler plug arranged on the respective end. The storage cartridge may then be refilled by pushing the detergent tablets from the refilling package into the storage cartridge, such that the ordered arrangement of the detergent tablets is secured. For this, a specific connector piece may be necessary.

According to an embodiment of the dosing unit, the dosing device is arranged at one end of the tubular section of the storage cartridge such that only the first detergent tablet in the line is arranged at the dosing device at a given time.

This embodiment ensures that precisely one detergent tablet is released by the dosing device in one dosing operation. For example, the dosing device has a pre-dosing chamber with a volume which takes up exactly one of the detergent tablets.

According to a further embodiment of the dosing unit, the tubular section has a cross section in a plane perpendicular to an extension direction of the tubular section which is selected as a function of the size and form of the detergent tablets, such that the detergents tablets are movable along the tubular section without tilting.

This embodiment has the advantage that a jamming of the tubular section by wedging of a detergent tablet is reduced or avoided. For example, in the case of cylindrical detergent tablets with a radius of 5 mm and a height of 10 mm, the cross section of the tubular section may be a square with 10.2 mm edge length.

According to a further embodiment of the dosing unit, a central axis of the tubular section forms a curved path.

This embodiment has the advantage that the maximum length of the tubular section is not restricted by a maximum edge length of the water-bearing household appliance, in which the dosing unit is to be used. Therefore, a storage capacity of the storage cartridge may be increased. Also, the dosing unit can be made more compact. Transport of the detergent tablets along the curved tubular section may involve a tilting, swiveling and/or rotating of the storage cartridge.

According to a further embodiment of the dosing unit, a central axis of the tubular section forms a spiral path.

This embodiment has the same advantages as noted above. In particular, the spiral form provides an optimal storage capacity, while sharp curves in the tubular section are omitted. Transport of the detergent tablets along the tubular section is therefore simple.

Particularly, the detergent tablets are transported when the storage cartridge is turned about an axis through the center of the spiral path and perpendicular to the spiral path.

According to a further embodiment of the dosing unit, the dosing device is arranged at the end of the tubular section at maximum radius of the spiral path.

In this embodiment, the detergent tablets need to be transported outwards with respect to a center of the spiral path along the spiral path. This embodiment has the advantage that a pile of detergent tablets is arranged in the storage cartridge such that they automatically slide towards the dosing device after one detergent tablet was released. Therefore, turning of the storage cartridge for transporting the detergent tablets is not necessary after each dosing, but only after a number of dosing operations.

According to a further embodiment of the dosing unit, the dosing device is arranged at the end of the tubular section in a center of the spiral path.

According to a further embodiment of the dosing unit, the dosing unit or the storage cartridge is configured to be turned about an axis through the center of the spiral path perpendicular to the spiral path for transporting the detergent tablets along the tubular section.

For example, the dosing unit comprises a bearing arranged at the center of the spiral path, which is to be connected to a shaft or the like of an automatic dosing system.

According to a further embodiment of the dosing unit, each of the detergent tablets of the plurality has a shape of a cylinder and is arranged in the tubular section of the storage cartridge such that each of the detergent tablets can roll along the tubular section.

For example, in the case of cylindrical detergent tablets, the tablets roll easily on a plane that is parallel to an axis through the centers of the circular faces of the cylindrical bodies, i.e. that is tangential to their circumference.

According to a further embodiment of the dosing unit, the dosing unit comprises a plurality of storage cartridges.

In this embodiment, the dosing unit may be particularly configured for dosing different kinds of detergent, wherein each of the storage cartridges is configured for storing and providing detergent tablets of one kind of detergent.

According to a further embodiment of the dosing unit, a central axis of each tubular section of each of the storage cartridges forms a spiral path and the storage cartridges are stacked on each other.

In this embodiment, an automatic dosing system can be designed relatively simple, because only one means for turning the plurality of storage cartridges is necessary for transporting the detergent tablets in each of the storage cartridges.

Additionally, only one dosing device is needed for dosing the detergent tablets provided by the different storage cartridges. Therefore, the dosing unit is kept simple.

According to a further embodiment of the dosing unit, a sensor unit for sensing a presence of a detergent tablet is arranged at a position along the tubular section such that a distance between the sensor unit and the end of the tubular section at which the dosing device is arranged along a central axis of the tubular section corresponds to a predetermined number of detergent tablets.

Advantageously, it is known when transport of detergent tablets by rotation is necessary in this embodiment. Further, the sensor unit may detect when the storage cartridge is empty and needs to be replaced. Additionally, in the case of a spiral tubular section, a current filling level of the storage cartridge can be determined by first rotating the storage cartridge such that all detergent tablets move away from the dosing device. Then, the number of rotations needed until a detergent tablet is detected by the sensor unit is counted, from which the filling level can be inferred.

According to a further embodiment of the dosing unit, the storage cartridge comprises plastic, metal, foil, ceramic, fiber and/or a composite material.

Preferably, the storage cartridge is made from a rather thin walled material, in order to save resources.

According to second aspect, a water-bearing household appliance with an automatic dosing system and a dosing unit according to the first aspect is suggested. The automatic dosing system is configured for automatically dosing at least one detergent tablet from the dosing unit.

It is to be understood that the automatic dosing system is specifically implemented to be employed together with the dosing unit according to the first aspect. For example, the automatic dosing system includes a driving device for turning the dosing unit about its central axis for transporting the detergent tablets and it is configured for actuating the dosing device of the dosing unit to release the detergent tablet. For example, the dosing device includes a sliding mechanism as described above.

For example, the water-bearing household appliance is implemented as a dishwasher or a washing machine. The automatic dosing system with the dosing unit has the advantage that detergent tablets for multiple treatment cycles can be provided, without the need to fill in detergent before each cycle. Preferably, the dosing of a detergent tablet by the automatic dosing system is triggered automatically, for example by a control unit of the water-bearing household appliance. Preferably, the automatic dosing system is configured for dosing exactly one detergent tablet at a time from the dosing unit.

In preferred embodiments, the automatic dosing system is configured for removably receiving the dosing unit. For example, the automatic dosing system comprises a compartment for receiving the dosing unit. This has the advantage that when the dosing unit runs out of detergent tablets, the empty dosing unit may simply be replaced by a full dosing unit. Alternatively or additionally, it may be possible to remove the empty dosing unit, refill the dosing unit with detergent tablets in a comfortable way, and the reinstall the refilled dosing unit.

Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

Figure 2:
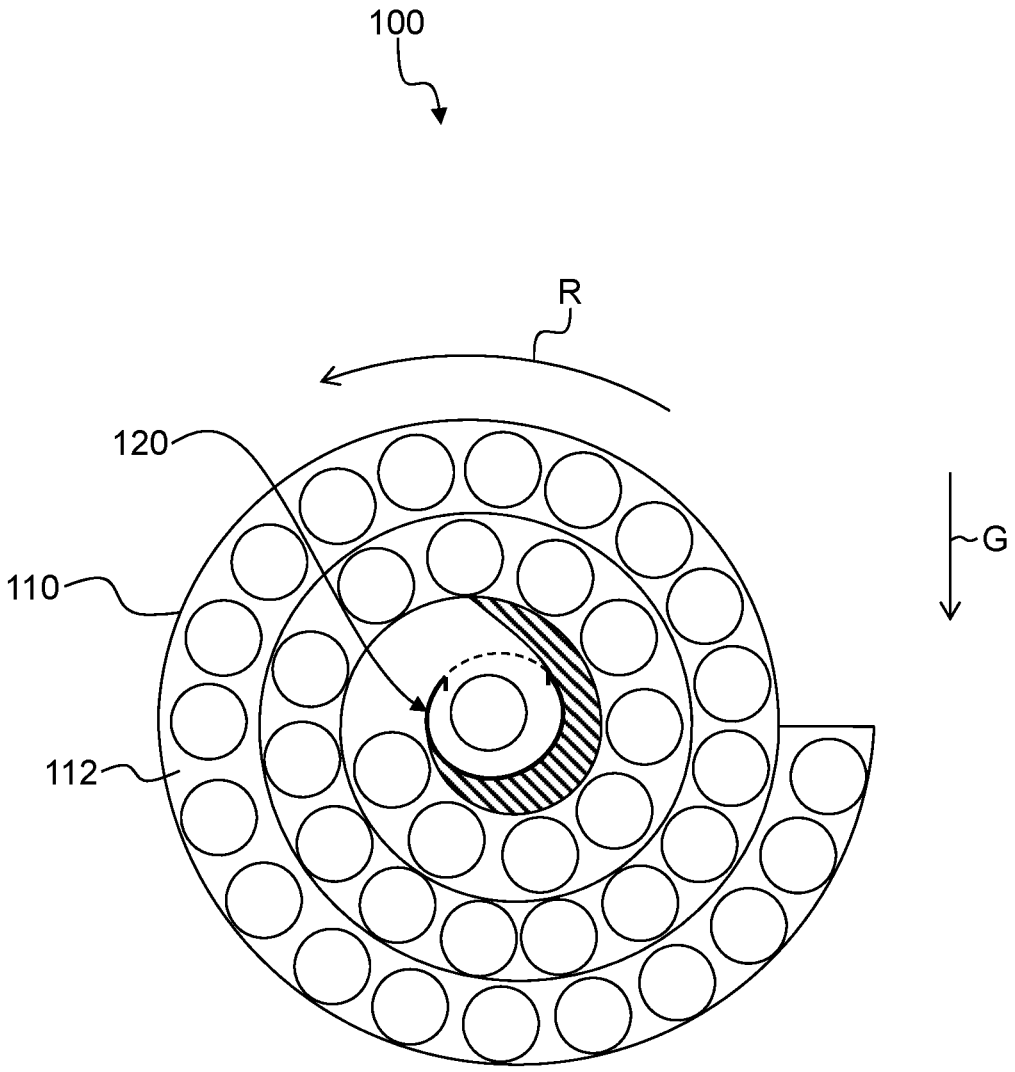
FIG. 2 shows a schematic view of a second example of a dosing unit.
Figure 3:
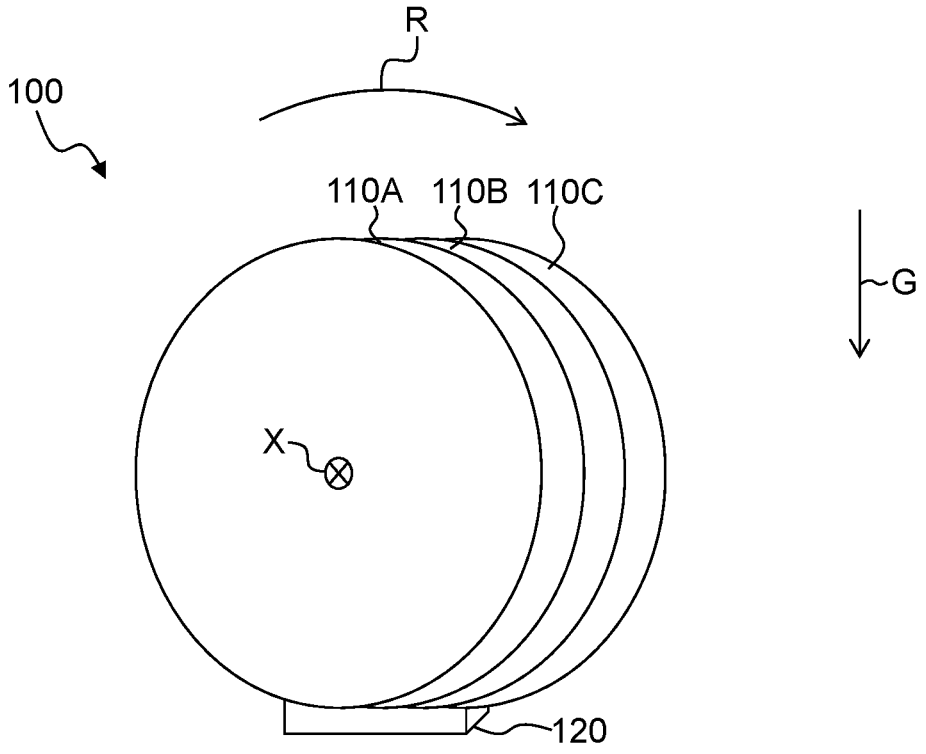
FIG. 3 shows a perspective schematic view of a third example of a dosing unit.
Figure 4:
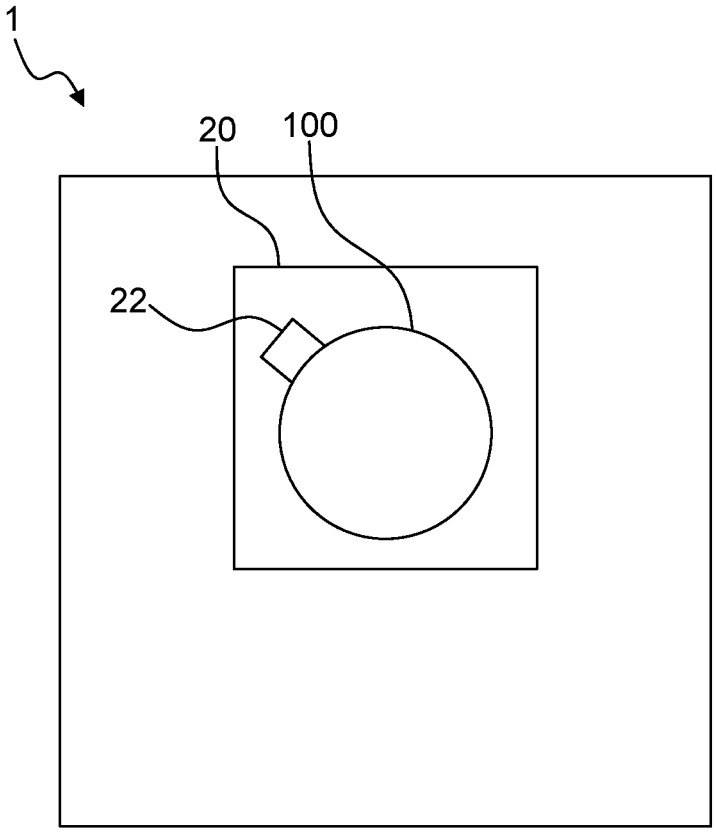
FIG. 4 shows a schematic view of an example of a dosing unit employed in a water bearing household appliance.
Figure 5:
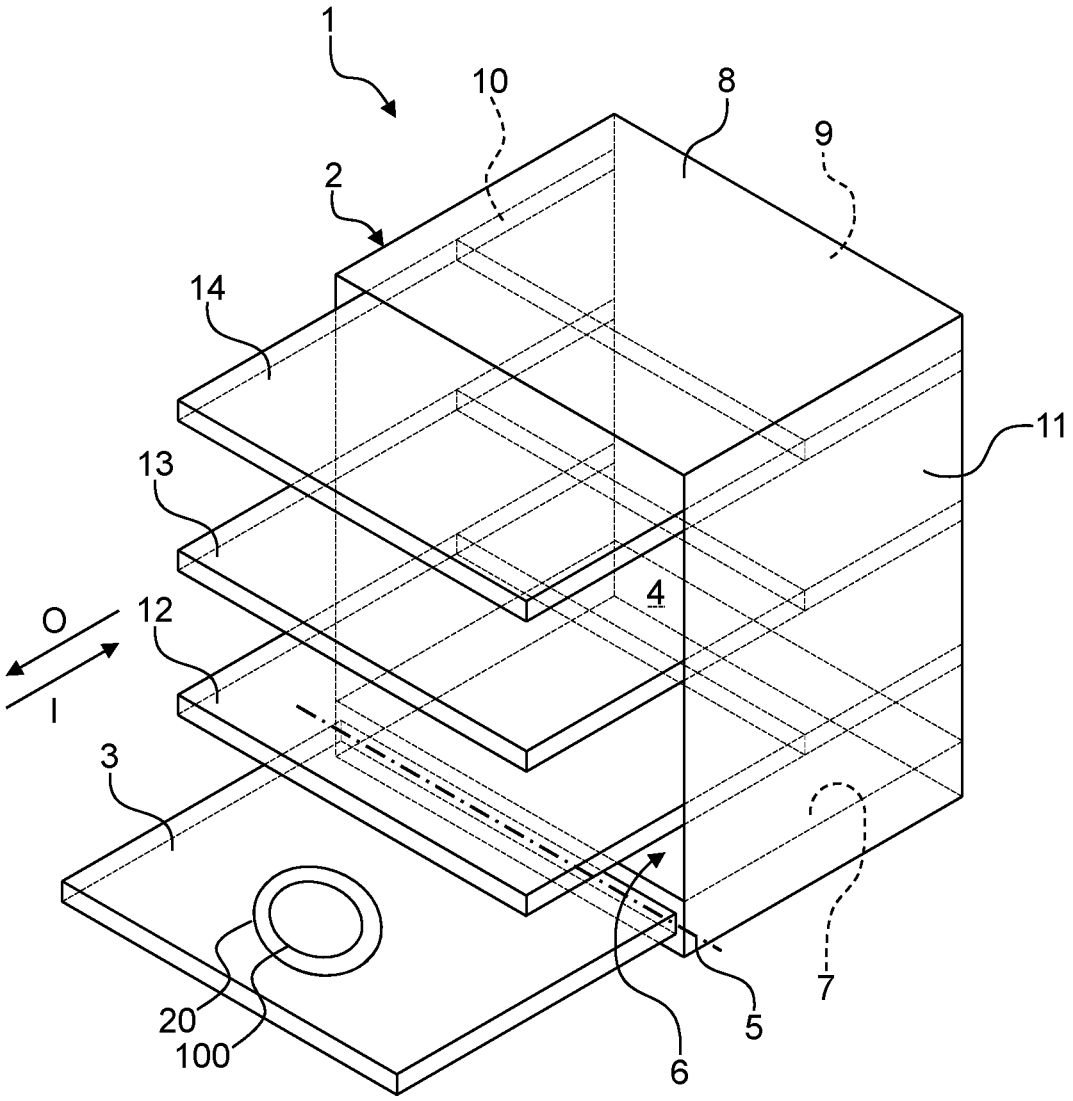
FIG. 5 shows a schematic perspective view of an example of a water-bearing household appliance.

Further embodiments, features and advantages of the present invention will become apparent from the subsequent description and dependent claims, taken in conjunction with the accompanying drawings, in which:

FIG. 1 shows a schematic view of a first example of a dosing unit;

FIG. 2 shows a schematic view of a second example of a dosing unit;

FIG. 3 shows a perspective schematic view of a third example of a dosing unit;

FIG. 4 shows a schematic view of an example of a dosing unit employed in a water-bearing household appliance; and FIG. 5 shows a schematic perspective view of an example of a water-bearing household appliance.

In the Figures, like reference numerals designate like or functionally equivalent elements, unless otherwise indicated.

FIG. 1 shows a schematic view of a first example of a dosing unit 100. The dosing unit 100 has a storage cartridge 110 and a dosing device 120. The storage cartridge 110 has a tubular section 112, a central axis of which forms a spiral path. The tubular section 112 is configured for storing and guiding detergent tablets 102 along the spiral path. For example, the detergent tablets 102 have a form of a cylinder and can roll along the tubular section 112.

The dosing unit 100 is configured to be employed in an automatic dosing system 20 (see FIG. 4 or 5) of a water-bearing household appliance 1 (see FIG. 4 or 5). The dosing unit 100 and the automatic dosing system 20 are designed to match each other such that the dosing unit 100 is arranged in the automatic dosing system 20 rotatable about a central axis X. When the dosing unit 100 is rotated in direction R about the axis X, detergent tablets 102 will effectively roll towards the dosing device 120, which is attached to an end of the tubular section 112 away from the center of the spiral path.

The dosing device 120 is configured for releasing the respective detergent tablet 102 that is currently arranged at the end of the tubular section 112. For example, the dosing device 120 is configured for switching between a closed state and a release or open state by being rotated or slid. In embodiments, the dosing device 120 includes a push rod for pushing the respective detergent tablet 102 out through a flexible lock or the like.

Next to the dosing device 120, a sensor unit 130 is arranged. The sensor unit 130 is configured for detecting or sensing a presence of a detergent tablet 102 next to it. When the sensor unit 130 detects a detergent tablet 102, at least two more dosing operations are possible, before the storage cartridge 110 or the whole dosing unit 100 needs to be rotated. In other embodiments, the sensor unit 130 may be arranged at a different position along the tubular section 112 than shown in FIG. 1. In the example of FIG. 1, seven detergent tablets 102 are arranged in the storage cartridge 110 in a position such that they move or roll automatically towards the dosing device 120 after one detergent tablet 102 was released, driven by gravity G. Therefore, seven dosing operations can be performed, before the storage cartridge 110 or the whole dosing unit 100 needs to be rotated. Therefore, the pile of detergent tablets 102 arranged in the upward arch starting from the dosing device 120 can be considered a buffer of detergent tablets 102.

Due to the arrangement of the detergent tablets 102 in a line one behind the other, an exposure to humidity, which may enter the storage cartridge 110 during a dosing operation, is essentially limited to the detergent tablet 102 that is next in the line, because it will absorb most of the humidity. Thus, the other detergent tablets 102 are protected from humidity. It is not a problem that the first detergent tablet 102 is exposed to a little bit of humidity, because it is already arranged in the dosing device 120 and does not have to roll along the tubular section 112, but will be released in the next dosing operation.

FIG. 2 shows a schematic view of a second example of a dosing unit 100. The dosing unit 100 of this example has a storage cartridge 110 with a tubular section 112 with a central axis that forms a spiral path. In contrast to the first example, the dosing device 120 is arranged at the end of the tubular section 112 in the center of the spiral path. The storage cartridge 110 or the whole dosing unit 100 is intended to be arranged rotatably about a central axis (not shown in FIG. 2 for better overview), as described with reference to the first example. However, in contrast to the first example, the rotation direction R is opposite in order to transport the detergent tablets 102 towards the dosing device 120. The dosing device 120 is preferably configured as a sliding mechanism, for sliding the detergent tablet 102 out of the plane of the storage cartridge 110 for releasing the detergent tablet 102.

FIG. 3 shows a perspective schematic view of a third example of a dosing unit 100. The dosing unit 100 of this example comprises three storage cartridges 110A, 110B, 110C. Each of the storage cartridges 110A, 110B, 110C is implemented similar to the storage cartridge 100 described with reference to FIG. 1. The three storage cartridges 110A, 110B, 110C are arranged stacked next to each other with a common central axis X. Below the stack of the storage cartridges 110A, 110B, 110C, a single dosing device 120 is arranged.

For example, storage cartridge 110A is configured for storing detergent tablets 102 (see FIG. 1 or 2) with dishwasher detergent, storage cartridge 110B is configured for storing detergent tablets 102 with enzyme, and storage cartridge 110C is configured for storing detergent tablets 102 with a rinse aid. Therefore, when used in a dishwasher, a respective detergent tablet 102 from the storage cartridge 110A, 110B or 110C is dosed at different timings during a treatment cycle. In particular, the dosing device 120 is configured for selectively releasing one respective detergent tablet 102 from one of the storage cartridges 110A, 110B, 110C at one time. Advantageously, only one driving unit 22 (see FIG. 4) is needed for rotating the three storage cartridges 110A, 110B, 110C.

FIG. 4 shows a schematic view of an example of a dosing unit 100 employed in a water-bearing household appliance 1, which is implemented as a dishwasher. The dishwasher 1 has an automatic dosing system 20 arranged on a door. The automatic dosing system 20 is configured for removably receiving a dosing unit 100, for example one of the dosing units 100 described with reference to FIGS. 1-3. The automatic dosing system 20 has a driving unit 22, which is configured for driving the dosing unit 100. For example, the driving unit 22 is configured for rotating the storage cartridge 110 or the whole dosing unit 100 in order to transport detergent tablets 102 (see FIG. 1 or 2) to a dosing device 120 (see FIG. 1-3) of the dosing unit 100. Further, the driving unit 22 is preferably implemented to operate the dosing device 120 of the dosing unit 100. The automatic dosing system 20 is configured for automatically dosing one detergent tablet 102 at a time into the dishwasher 1.

FIG. 5 shows a schematic perspective view of an example of a water-bearing household appliance 1, which is implemented as a domestic dishwasher. The domestic dishwasher 1 comprises a tub 2, which can be closed by a door 3. Preferably, the door 3 seals the tub 2 so that it is waterproof, for example by using a door seal between door 3 and the tub 2. Preferably, the tub 2 has a cuboid shape. Tub 2 and door 3 can form a washing chamber 4 for washing dishes.

In FIG. 5, door 3 is shown in the open position. By swiveling about an axis 5 at a lower edge of door 3, the door 3 can be opened or closed. With the door 3, an opening 6 of the tub 2 for inserting dishes into the washing chamber 4 can be opened or closed. Tub 2 comprises a lower cover 7, an upper cover 8 facing the lower cover 7, a rear cover 9 facing the closed door 3 and two side covers 10, 11 which face each other. For example, the lower cover 7, the upper cover 8, the rear cover 9 and the two side covers 10, 11 can be made from stainless steel sheets. Alternatively, at least one of the covers, for example the lower cover 7, can be made from a polymeric material, such as plastic.

The domestic dishwasher 1 further has at least one rack 12, 13, 14 on which dishes to be washed can be placed. Preferably, more than one rack 12, 13, 14 is used, wherein rack 12 can be lower rack, rack 13 can be an upper rack and rack 14 can be a rack specific for cutlery. As is shown in FIG. 5, the racks 12 to 14 are arranged vertically above each other in the tub 2. Each rack 12, 13, 14 can be pulled out from the tub 2 in a first, outward direction O or pushed into the tub 2 in a second, inward direction I.

FIG. 5 further shows an automatic dosing system 20 that is arranged in or at the door 3 of the domestic dishwasher 1. The automatic dosing system 20 comprises a dosing unit 100 that is removably fixed in the automatic dosing system 20. The automatic dosing system 20 has a driving unit 22 (see FIG. 4) configured to actuate the dosing unit 100 for automatically dosing a detergent tablet 102 (see FIG. 1 or 2) provided by a storage cartridge 110 (see FIG. 1-3) of the dosing unit 100. Preferably, the automatic dosing system 20 is controlled by a control unit (not shown), which is implemented for operating the domestic dishwasher 1 according to a treatment program selected from a plurality of treatment programs. Further, in preferred embodiments, the automatic dosing system 20 may include a case for removably receiving the dosing unit 100 for protecting the dosing unit 100 from the surrounding conditions, in particular heat and humidity. Additionally, the automatic dosing system 20 may comprise a dosing channel, wherein the dosing unit 100 releases the detergent tablet 102 into the dosing channel, which is implemented for guiding the released detergent tablet 102 into the washing chamber 4.

Although the present invention has been described in accordance with preferred embodiments, it is obvious for the person skilled in the art that modifications are possible in all embodiments.

REFERENCE NUMERALS

1 water-bearing household appliance
2 tub
3 door
4 washing chamber
5 axis
6 opening
7 lower cover
8 top cover
9 rear cover
10 side cover
11 side cover
12 rack
13 rack
14 rack
20 automatic dosing system
22 driving unit
100 dosing unit
102 detergent tablet
110 storage cartridge
110A storage cartridge
110B storage cartridge
110C storage cartridge
112 tubular section
120 dosing device
130 sensor unit
G gravity
I direction
R rotation
O direction
X axis

The invention claimed is:

1. A dosing unit for use in an automatic dosing system of a water-bearing household appliance for automatically dosing detergent tablets, the dosing unit comprising:

a storage cartridge for storing a plurality of the detergent tablets; and a dosing device for releasing a respective one of the detergent tablets, wherein the storage cartridge includes a tubular section for storing the plurality of detergent tablets ordered in a line one behind another, wherein a central axis of the tubular section forms a spiral path; and wherein the dosing unit or the storage cartridge is configured to be turned about an axis (X) through a center of the spiral path perpendicular to the spiral path for transporting the detergent tablets along the tubular section.

2. The dosing unit according to claim 1, wherein the dosing device is arranged at one end of the tubular section of the storage cartridge, such that only a first detergent tablet in the line is arranged at the dosing device at a given time.

3. The dosing unit according to claim 2, wherein a sensor unit for sensing a presence of a detergent tablet is arranged at a position along the tubular section such that a distance between the sensor unit and the end of the tubular section at which the dosing device is arranged along a central axis of the tubular section corresponds to a predetermined number of detergent tablets.

4. The dosing unit according to claim 1, wherein the tubular section has a cross section in a direction perpendicular to an extension direction of the tubular section which is selected as a function of the size and form of the detergent tablets, such that the detergent tablets are movable along the tubular section without tilting.

5. The dosing unit according to claim 1, wherein the dosing device is arranged at an end of the tubular section at a maximum radius of the spiral path.

6. The dosing unit according to claim 1, wherein the dosing device is arranged at an end of the tubular section in a center of the spiral path.

7. The dosing unit according to claim 1, wherein each of the detergent tablets of the plurality of the detergent tablets has a shape of a cylinder and is arranged in the tubular section of the storage cartridge such that each of the detergent tablets can roll along the tubular section.

8. The dosing unit according to claim 1, comprising a plurality of storage cartridges.

9. The dosing unit according to claim 8, wherein a central axis of each tubular section of each of the plurality of storage cartridges forms a spiral path and the storage cartridges are stacked on each other.

10. The dosing unit according to claim 1, wherein the storage cartridge comprises plastic, metal, foil, ceramic, fiber and/or a composite material.

11. A water-bearing household appliance comprising:

an automatic dosing system; and a dosing unit according to claim 1; and wherein the automatic dosing system is configured for automatically dosing at least one detergent tablet from the dosing unit.

12. The water-bearing household appliance according to claim 11, wherein the automatic dosing system is configured for removably receiving the dosing unit.

13. A dosing unit for use in an automatic dosing system of a water-bearing household appliance for automatically dosing detergent tablets, the dosing unit comprising:

a storage cartridge for storing a plurality of the detergent tablets; and a dosing device for releasing a respective one of the detergent tablets, wherein the storage cartridge includes a tubular section for storing the plurality of detergent tablets ordered in a line one behind another; and wherein each of the detergent tablets of the plurality of the detergent tablets has a shape of a cylinder and is arranged in the tubular section of the storage cartridge such that each of the detergent tablets can roll along the tubular section.

14. The dosing unit according to claim 13, wherein the dosing device is arranged at one end of the tubular section of the storage cartridge, such that only a first detergent tablet in the line is arranged at the dosing device at a given time.

15. The dosing unit according to claim 14, wherein a sensor unit for sensing a presence of a detergent tablet is arranged at a position along the tubular section such that a distance between the sensor unit and the end of the tubular section at which the dosing device is arranged along a central axis of the tubular section corresponds to a predetermined number of detergent tablets.

16. The dosing unit according to claim 13, wherein the tubular section has a cross section in a direction perpendicular to an extension direction of the tubular section which is selected as a function of the size and form of the detergent tablets, such that the detergent tablets are movable along the tubular section without tilting.

17. The dosing unit according to claim 13, wherein at least one of:

a central axis of the tubular section forms a curved path;

a central axis of the tubular section forms a spiral path; and/or the storage cartridge comprises plastic, metal, foil, ceramic, fiber and/or a composite material.

18. The dosing unit according to claim 13, comprising a plurality of storage cartridges.

19. A water-bearing household appliance comprising:

an automatic dosing system; and a dosing unit according to claim 13; and wherein the automatic dosing system is configured for automatically dosing at least one detergent tablet from the dosing unit.

20. The water-bearing household appliance according to claim 19, wherein the automatic dosing system is configured for removably receiving the dosing unit.

* * * * *